US009994783B2

(12) United States Patent
Yamamoto et al.

(10) Patent No.: US 9,994,783 B2
(45) Date of Patent: Jun. 12, 2018

(54) METHOD FOR PRODUCING MODIFIED COAL, AND MODIFIED COAL

(71) Applicant: KOBE STEEL, LTD., Kobe-shi (JP)

(72) Inventors: Seiichi Yamamoto, Takasago (JP); Takuo Shigehisa, Takasago (JP); Naoto Watanabe, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 28 days.

(21) Appl. No.: 14/917,499

(22) PCT Filed: Sep. 9, 2014

(86) PCT No.: PCT/JP2014/073819
§ 371 (c)(1),
(2) Date: Mar. 8, 2016

(87) PCT Pub. No.: WO2015/049961
PCT Pub. Date: Apr. 9, 2015

(65) Prior Publication Data

US 2016/0215227 A1 Jul. 28, 2016

(30) Foreign Application Priority Data

Oct. 1, 2013 (JP) ..... 2013-206307

(51) Int. Cl.
*C10L 5/00* (2006.01)
*C10L 5/24* (2006.01)
(Continued)

(52) U.S. Cl.
CPC ..... *C10L 5/24* (2013.01); *C10L 5/04* (2013.01); *C10L 5/366* (2013.01); *C10L 9/06* (2013.01);
(Continued)

(58) Field of Classification Search
CPC ..... C10L 2290/08; C10L 2290/146; C10L 2290/18; C10L 2290/28; C10L 2290/30;
(Continued)

(56) References Cited

U.S. PATENT DOCUMENTS 3,723,079 A 3/1973 Seitzer
3,896,557 A 7/1975 Seitzer et al.
(Continued)

FOREIGN PATENT DOCUMENTS

CN 102149798 8/2011
JP 60-65097 A 4/1985
(Continued)

OTHER PUBLICATIONS

Extended European Search Report dated Feb. 10, 2017 in European Patent Application No. 14850366.7.
(Continued)

*Primary Examiner* — Latosha Hines
(74) *Attorney, Agent, or Firm* — Oblon, McClelland, Maier & Neustadt, L.L.P.

(57) ABSTRACT

A method for producing modified coal using coal of a low grade comprising:

adding water for preventing any dust generation to the dewatered coal; an addition amount of the water is adjusted for a water content rate of the water-added coal to be 6% by mass or more to 16% by mass or less; agglomerating the water-added coal; slowly oxidizing the agglomerated coal; and crushing the oxidized coal.

12 Claims, 2 Drawing Sheets

(51) Int. Cl.
*C10L 9/06* (2006.01)
*C10L 5/04* (2006.01)
*C10L 5/36* (2006.01)

(52) U.S. Cl.
CPC ..... *C10L 2290/08* (2013.01); *C10L 2290/146* (2013.01); *C10L 2290/18* (2013.01); *C10L 2290/28* (2013.01); *C10L 2290/30* (2013.01); *C10L 2290/32* (2013.01)

(58) Field of Classification Search
CPC ..... C10L 2290/32; C10L 5/04; C10L 5/24; C10L 5/366; C10L 9/06
See application file for complete search history.

(56) References Cited

U.S. PATENT DOCUMENTS 4,645,513 A 2/1987 Kubota et al.
4,797,136 A * 1/1989 Siddoway ..... C10L 9/02 34/393
2006/0156622 A1 * 7/2006 Katayama ..... C10L 9/08 44/626
2012/0291342 A1 11/2012 Sugita et al.

FOREIGN PATENT DOCUMENTS

JP 64-62394 A 3/1989
JP 2-298586 A 12/1990
JP 2011-37938 * 2/2011
JP 2011-37938 A 2/2011
JP 2011037938 A * 2/2011 ..... C10B 57/10
WO 2010/044376 A1 4/2010

OTHER PUBLICATIONS

International Preliminary Report on Patentability and Written Opinion of the International Searching Authority dated Apr. 14, 2016 in PCT/JP2014/073819 filed Sep. 9, 2014.
International Search Report dated Dec. 16, 2014 in PCT/JP2014/073819 dated Sep. 9, 2014.

* cited by examiner

METHOD FOR PRODUCING MODIFIED COAL, AND MODIFIED COAL

TECHNICAL FIELD

The present invention relates to a method for producing modified coal, and the modified coal.

BACKGROUND ART

Low grade coal (lowly carbonized coal) such as brown coal and subbituminous coal contains much water and the amount of heat generated thereby per unit mass is therefore small and the transportation efficiency thereof is low. Because the reserve of the low grade coal is however abundant, from the viewpoint of the effective use of the resource, the low grade coal is dewatered and is thereafter compression-molded into a specific size to be used as fuel with an increased amount of heat generated thereby per unit mass and an improved handling property.

The low grade coal has a nature that the surface activity thereof is high and the low grade coal tends to react with oxygen, and may therefore spontaneously ignite when the low grade coal is exposed to air during transportation and storage thereof. To prevent the spontaneous ignition, aging is generally conducted therefor according to which a specific amount of air (oxygen) is supplied to the coal after the compression molding and the coal is thereby slowly oxidized to be stabilized. For example, a method has been proposed as a method of the aging, according to which the reactivity of the coal is degraded by applying thereto hydration treatment and oxidization treatment (see Japanese Laid-Open Patent Publication No. 2011-37938).

The coal applied with the aging as above method is crushed to adjust its particle size for its storage. The crushed coal tends to generate dust during the transportation thereof and the like. Adding water to the coal by sprinkling water thereon is effective to prevent the dust generation.

The inventors however found that, when the water was added to the coal after the aging, the spontaneous ignition property was enhanced due to the recovery of the surface activity of the coal. When the water is sprinkled on the coal after the aging, the reaction rate (the oxygen consumption rate) of the coal is increased and the effect of the aging is degraded resulting in enhancement of the spontaneous ignition property. The traditional method has therefore difficulty in simultaneously realizing the dust generation preventive property and the spontaneous ignition preventive property.

CITATION LIST

Patent Document

Patent Document 1: Japanese Laid-Open Patent Publication

SUMMARY OF THE INVENTION

Problem to be Solved by the Invention

The present invention has been conceived in view of the above circumstances and an object thereof is to provide a method for producing modified coal, that uses low grade coal as the raw material thereof and that can suppress any dust generation and any spontaneous ignition thereof.

Means for Solving the Problem

As a result of active studies to solve the problem, the inventors have been found that modified coal whose dust generation property and whose spontaneous ignition property are degraded is able to be acquired by adding water for preventing the dust generation before the dewatered coal is shaped into agglomerated coal.

The invention completed to solve the problem is a method for producing modified coal using low grade coal as a raw material thereof, comprising:

dewatering the coal;

adding water for preventing any dust generation to the dewatered coal;

agglomerating the water-added coal;

slowly oxidizing the agglomerated coal; and crushing the oxidized coal, wherein at the step of adding water, the addition amount of the water is adjusted for the water content rate of the water-added coal to be from 6% by mass or more to 16% by mass or less.

According to the method for producing modified coal, after the step of dewatering, the water for preventing the dust generation is added to the dewatered coal before the agglomerating step for the water content rate to be within the above range, and the aging to slowly oxidize the coal is thereafter conducted. Modified coal can thereby be easily and securely acquired that has a weak dust generation property and a weak spontaneous ignition property. The addition of the specific amount of water before the agglomerating and the aging of the coal excludes any necessity of adding much water to the coal after the crushing because this water suppresses the dust generation of the coal. As a result, according to the method for producing modified coal, factors are reduced that cause recovery of the activity after the aging of the coal and both of the dust generation property and the spontaneous ignition property of the acquired modified coal can be weakened.

It is advantageous to add substantially no water to the crushed coal. Any recovery of the coal activity can more securely be prevented and the spontaneous ignition property can be weakened by adding substantially no water to the coal after the crushing as above.

When substantially no water is added to the crushed coal after the step of crushing, at the step of adding water, preferably, the addition amount of the water is adjusted for the water content rate of the crushed coal after the step of crushing to be from 10% by mass or more to 16% by mass or less. Addition of the water at the step of adding water for the water content rate of the coal after the crushing to be within the above range enables prevention of any reduction of the amount of heat generated by the coal maintaining the reaction rate of the coal after the crushing to be equal to a specific value or lower, and high quality modified coal having a weak spontaneous ignition property can therefore be acquired.

The method for producing modified coal may further include a step of secondarily adding water for preventing the dust generation to the crushed coal. Use of the method including the secondary addition of water to the crushed coal as above enables production of the agglomerated coal with water suitable for the step of agglomerating and the quality of the acquired modified coal can therefore be further improved.

When the water for preventing the dust generation is added secondarily to the crushed coal, at the step of adding water, preferably, the addition amount of the water is adjusted for the water content rate of the water-added coal to be from 6% by mass or more to 12% by mass or less and, at the step of the secondary addition, preferably, the addition amount of the water is adjusted for the water content rate of the crushed coal to be from 10% by mass or more to 16% by mass or less. Addition of the water at the step of adding water and the step of secondary addition for the water content rate of the coal after the crushing to be within the above ranges enables improvement of the quality of the agglomerated coal and prevention of any reduction of the amount of heat generated by the coal maintaining the reaction rate of the coal after the crushing to be equal to a specific value or lower. Higher quality modified coal having a weak spontaneous ignition property can therefore be acquired.

At the step of adding water, preferably, a portion or all of the water for preventing the dust generation is added to the dewatered coal by adding the raw material coal containing water to the dewatered coal. The substitution for the portion or all of the addition of the water for preventing the dust generation by the addition of the raw material coal containing water enables an increase of the production amount of the modified coal and facilitation of cost reduction.

The modified coal acquired using the method for producing modified coal is therefore excellent in the dust generation preventive property and the spontaneous ignition preventive property and is advantageously usable as fuel.

Representing the mass of the water contained in the coal as "W1" and the mass of the dried coal as "W2", the "water content rate" is a value determined according to $W1/(W1+W2)\times 100$.

Advantageous Effects of the Invention

As described above, the method for producing modified coal of the present invention can provide modified coal that uses low grade coal as the raw material thereof and that can suppress any dust generation and any spontaneous ignition thereof. The method for producing modified coal can modify low grade coal into fuel that is safe and that is excellent in the transportation cost and the handling property.

EMBODIMENTS FOR CARRYING OUT THE INVENTION

Figure 1:
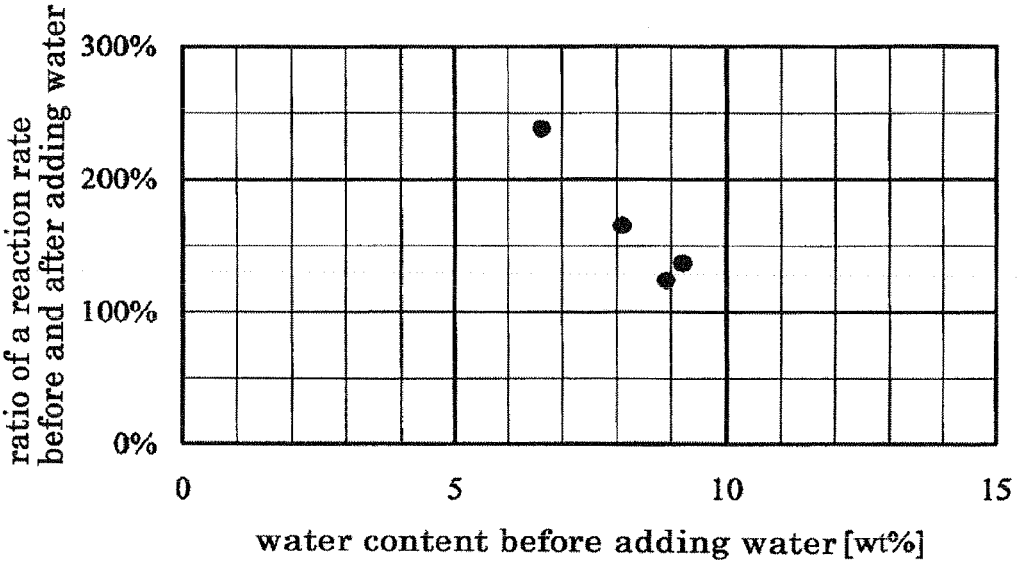
FIG. 1 is a graph showing the relation between the water content rate of coal before being crushed, and a ratio of a reaction rate after sprinkling water on the coal to the reaction rate before sprinkling water thereon after the crushing.

Embodiments of a method for producing modified coal of the present invention will be described in detail.

First Embodiment

The method for producing modified coal according to a first embodiment comprising:

dewatering low grade coal (a dewatering step);

adding water for preventing any dust generation to the dewatered coal (a water addition step);

agglomerating the water-added coal (an agglomerating step);

slowly oxidizing the agglomerated coal (an aging step); and crushing the oxidized coal (a crushing step).

In the method for producing modified coal according to the first embodiment, substantially no water is added to the crushed coal after the crushing step.

The low grade coal as the raw material used in the present invention refers to coal that naturally occurs and that contains water of 20% by mass or more. Examples of the low grade coal include, for example, brown coal such as Victorian coal, North Dakotan coal, and Bergan coal, subbituminous coal such as West Banco coal, Binungan coal, and Saramangau coal, and the like.

The upper limit of the largest particle diameter of the low grade coal, preferably, is 3 mm, more preferably, is 2 mm, and, yet more preferably, is 1 mm. The lower limit of the rate of particles each having a particle diameter of 0.5 mm or smaller of the low grade coal, preferably, is 50% by mass, more preferably, is 70% by mass, and yet more preferably, is 80% by mass. The strength of the coal after being shaped into agglomerated coal can be improved by setting the largest particle diameter of the low grade coal to be equal to the upper limit or smaller or by setting the rate of the particles each having a particle diameter of 0.5 mm or smaller thereof to be equal to the lower limit or larger. The largest particle diameter of the low grade coal can be measured using a screen. The rate of the particles each having a particle diameter of 0.5 mm or smaller can be determined from the total mass of screened low grade coal and the mass of the coal under a screen acquired by conducting classification using the screen whose aperture is 0.5 mm.

Dewatering Step

At the dewatering step, water is removed from the low grade coal. Examples of the method for the dewatering include an in-oil dewatering method of applying heat treatment to the coal in an oil, and a method of applying heat treatment to the coal in an inert gas atmosphere and, preferably, the in-oil dewatering method may be used from the viewpoint of the high water removal rate thereof.

According to the in-oil dewatering method, for example, the low grade coal is mixed with a petroleum-based light oil having a boiling point from 150° C. to 300° C. and the water in the low grade coal is evaporated to be removed by heating the mixture at 100° C. or higher. Thereafter, the low grade coal is extracted from the petroleum-based light oil and, thereafter, hot air drying is applied to the low grade coal to remove the petroleum-based light oil remaining in the low grade coal. In this case, the upper limit of the content of the petroleum-based light oil in the low grade coal, preferably, is 10% by mass, more preferably, is 3% by mass, and, yet more preferably, is 2% by mass.

Water Addition Step

At the water addition step, the water for preventing the dust generation is added to the dewatered coal that is dewatered. Though the method of adding the water is not especially limited, methods are usable such as, for example, atomization using a spray and the like and immersion in a water storage tank. Especially, the facility and the process steps can be simplified by atomizing water using a spray onto the dewatered coal conveyed from the site of the dewatering step to the site of the agglomerating step. The water can more securely and more evenly be added to the dewatered coal by atomizing water onto the dewatered coal falling off from the connection point of belt conveyers.

A surface active agent may be added to the water for preventing the dust generation. Addition of the surface active agent improves the wettability of the dewatered coal for water and can more securely suppress the dust generation.

The water contained in the raw material coal is also usable as the water for preventing the dust generation. A portion or all of the water for preventing the dust generation may be added to the dewatered coal by adding the raw material coal containing water to the dewatered coal. Substitution for the portion or all of the addition of the water for preventing the dust generation by the addition of the raw material coal containing water enables an increase of the production of the modified coal and facilitation of cost reduction.

According to the method for producing modified coal, at the water addition step, the addition amount of water for preventing the dust generation is adjusted for the water content rate of the coal to be within a specific amount to acquire the water-added coal. The lower limit of the water content rate of the water-added coal is 6% by mass and, more preferably, is 8% by mass. On the other hand, the upper limit of the water content rate of the water-added coal is 16% by mass and, more preferably, is 15% by mass. Setting the water content rate of the water-added coal within the above ranges enables prevention of any reduction of the amount of heat generated by the coal maintaining the reaction rate of coal after its production at a constant value or lower.

More preferably, at the water addition step, the addition amount of the water for preventing the dust generation is adjusted for the water content rate of the crushed coal after the crushing step described later to be within a specific range. The lower limit of the water content rate of the crushed coal, preferably, is 10% by mass and, more preferably, is 11% by mass. When the water content rate of the crushed coal is lower than the lower limit, the prevention may be insufficient of the dust generation of the modified coal acquired using the method for producing modified coal. On the other hand, the upper limit of the water content rate of the crushed coal, preferably, is 16% by mass and, more preferably, is 15% by mass. When the water content rate of the crushed coal exceeds the upper limit, the amount of heat generated per unit mass of the modified coal acquired using the method for producing modified coal may be reduced and the value of the modified coal as fuel may be reduced.

Agglomerating Step

At the agglomerating step, to facilitate the aging described later, the water-added coal that is added with the water for preventing the dust generation is shaped into agglomerated coal. The shape of the agglomerated coal and the apparatus used in the agglomerating step are not especially limited. For example, a briquette produced by compression molding using a double-roll molding machine and the like, a pellet produced by tumbling granulation using a pan-type granulator and the like, a stick produced by extrusion molding using an extruder, and the like can be employed. Preferably, especially, the coal is shaped into briquettes each having an oval briquette shape from the viewpoint of the handling property.

The average mass of the agglomerated coal is not especially limited and may be, for example, from 10 g to 100 g. The average volume of the agglomerated coal is not especially limited and may be, for example, from 2 $cm^3$ to 200 $cm^3$.

Aging Step

At the aging step, the aging is conducted by slowly reacting the agglomerated coal with oxygen to oxidize the agglomerated coal. The method of aging is not especially limited and any known method is usable. For example, a method is usable according to which the agglomerated coal is put in a sealed container (an anaerobic box) and a specific amount of air is caused to flow upward from the bottom inside the sealed container.

The upper limit of the reaction rate (the oxygen consumption rate) of the oxidized coal after the aging, preferably, is 2 mg/g/day and, more preferably, is 1.5 mg/g/day. When the oxygen consumption rate of the oxidized coal after the aging exceeds the upper limit, the oxidized coal or the crushed coal formed by crushing the oxidized coal may spontaneously ignite. Setting the oxygen consumption rate of the oxidized coal after the aging to be equal to the upper limit or lower enables stable progress of the aging of the coal in the air atmosphere even after the aging step and enables enhancement of the stability of the modified coal acquired using the method for producing modified coal. The "oxygen consumption rate" means the amount of oxygen reacting in one day per unit mass of coal when the coal is placed in an atmosphere at 30° C. and containing 21% of oxygen.

Crushing Step

The modified coal can be acquired by crushing the oxidized coal after the aging at the crushing step. Preferably, the particle diameter distribution after the crushing is set to be a particle diameter distribution with which, when a screen of 10 mm is used, the modified coal passing through the screen is 50% by mass or more of the total amount thereof. Setting this particle diameter distribution enables the storage and the transportation of the coal to be easy.

The crushed modified coal is excellent in the dust generation preventive property and the spontaneous ignition preventive property and is advantageously usable as, for example, fuel for a thermal electric power station and the like.

Advantages

According to the method for producing modified coal, modified coal having a weak dust generation property and a weak spontaneous ignition property can easily and securely be acquired by adding, after the dewatering step, the water for preventing the dust generation to the coal before the agglomerating step and conducting thereafter the aging to slowly oxidize the coal. According to the method for producing modified coal, the coal contains a specific amount of water even without adding any water thereto after the crushing, by adding water thereto before the agglomerating of the coal and before the aging thereof. In addition, the dust generation can therefore be suppressed, the factors causing recovery of the activity after the aging can be reduced, and the spontaneous ignition property can be weakened. According to the method for producing modified coal, adding substantially no water to the coal after the crushing enables securer prevention of the recovery of the activity of the coal and weakening of the spontaneous ignition property.

Second Embodiment

The method for producing modified coal according to a second embodiment comprising:

dewatering low grade coal (a dewatering step);

adding water for preventing any dust generation to the dewatered coal (a water addition step);

agglomerating the water-added coal (a agglomerating step);

slowly oxidizing the agglomerated coal (an aging step);

crushing the oxidized coal (a crushing step); and secondarily adding water for preventing the dust generation to the crushed coal (a secondary addition step).

Dewatering Step

The dewatering step is same as that of the first embodiment and will not again be described.

Water Addition Step

The water addition step may be same as that of the first embodiment except the addition amount of the water.

At the water addition step, the addition amount of the water for preventing the dust generation is adjusted for the water content rate of the coal to be within a specific amount and the water-added coal is acquired. The lower limit of the water content rate of the water-added coal is 6% by mass and, more preferably, is 8% by mass. The inventors determined by testing the relation as depicted in FIG. 1 between the water content rate after the water addition step (before the agglomerating step) and the increase rate (ratio) of the reaction rate of the coal after the secondary addition step (after the sprinkling of water). The inventors found that the increase rate of the reaction rate of the coal after the secondary addition step increased in a linear function manner as the water content rate thereof after the water addition step became lower. When the water content rate of the water-added coal is lower than the lower limit, the reaction rate of the coal after the secondary addition step therefore may become high and the spontaneous ignition property may not sufficiently be reduced. On the other hand, the upper limit of the water content rate of the water-added coal is 12% by mass and, more preferably, is 10% by mass. When the water content rate of the water-added coal exceeds the upper limit, the strength of the agglomerated coal produced at the agglomerating step may be insufficient due to excess of the water.

Agglomerating Step

The agglomerating step may be same as that of the first embodiment and will not again be described.

Aging Step

The aging step may be same as that of the first embodiment except the reaction rate of the oxidized coal after aging.

The upper limit of the reaction rate (the oxygen consumption rate) of the oxidized coal after aging, preferably, is 1.5 mg/g/day and, more preferably, is 1 mg/g/day. When the oxygen consumption rate of the oxidized coal after aging exceeds the upper limit, the coal may spontaneously ignite after the secondary addition step. Setting the oxygen consumption rate of the oxidized coal after the aging to be equal to the upper limit or lower enables stable progress of the aging of the coal in an air atmosphere even after the secondary addition step and enables enhancement of the stability of the modified coal acquired using the method for producing modified coal.

Crushing Step

The crushing step may be same as that of the first embodiment and will not again be described.

Secondary Addition Step

At the secondary addition step, the water for preventing the dust generation is secondarily added to the crushed coal. The method of secondarily adding the water for preventing the dust generation is not especially limited and a method is usable such as, for example, atomization using a spray and the like. A surface active agent can be added to the water for preventing the dust generation. A portion or all of the addition of the water for preventing the dust generation may be substituted by addition of the raw material coal.

Preferably, at the secondary addition step, the addition amount of the water for preventing the dust generation is adjusted for the water content rate of the crushed coal after the crushing step to be within a specific range. The lower limit of the water content rate of the crushed coal, preferably, is 10% by mass and, more preferably, is 11% by mass. When the water content rate of the crushed coal is lower than the lower limit, the prevention of the dust generation of the modified coal acquired using the method for producing modified coal may be insufficient. On the other hand, the upper limit of the water content rate of the crushed coal, preferably, is 16% by mass and, more preferably, is 15% by mass. When the water content rate of the crushed coal exceeds the upper limit, the amount of heat generated per unit mass of the modified coal acquired using the method for producing modified coal may be reduced and the value thereof as fuel may be reduced.

The upper limit of the reaction rate (the oxygen consumption rate) of the crushed coal after the secondary addition step, preferably, is 2 mg/g/day and, more preferably, is 1.5 mg/g/day. When the oxygen consumption rate of the crushed coal after the secondary addition of the water for preventing the dust generation exceeds the upper limit, the crushed coal may spontaneously ignite. Setting the oxygen consumption rate of the crushed coal after the secondary addition of the water for preventing the dust generation to be equal to the upper limit or lower enables stable progress of the aging of the coal in an air atmosphere even after the secondary addition step and enables enhancement of the stability of the modified coal acquired using the method for producing modified coal.

Advantages

According to the method for producing modified coal, modified coal having a weak dust generation property and a weak spontaneous ignition property can easily and securely be acquired similarly to the first embodiment. According to the method for producing modified coal, the agglomerated coal with the water suitable for the agglomerating step can be produced by secondarily adding water to the crushed coal. The quality of the acquired modified coal can therefore be further improved.

EXAMPLES

The present invention will more specifically be described with reference to Examples while the present invention is not limited thereto.

Examples 1 to 4

Figure 2:
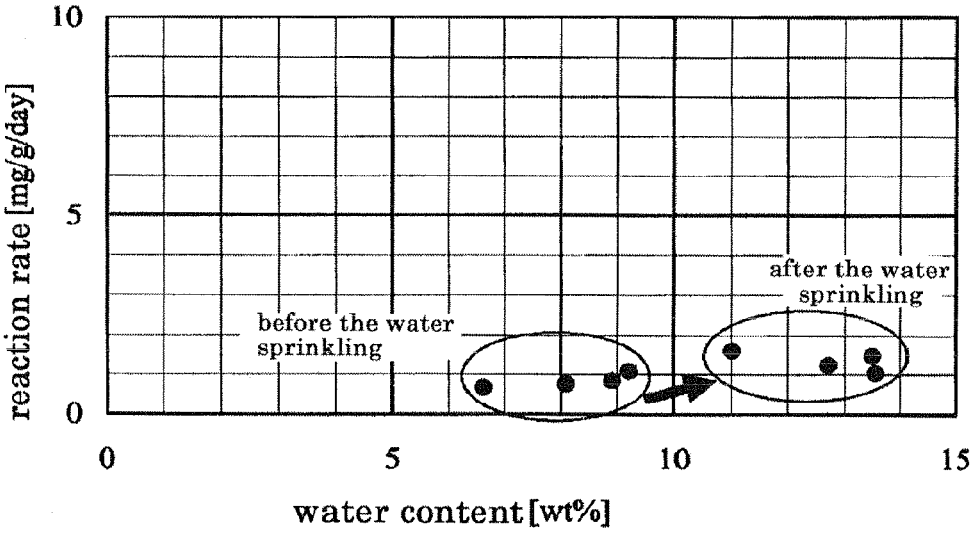
FIG. 2 is a graph showing the relation between the water content rate of the coal crushed after aging and the reaction rate thereof, and the relation between the water content rate after sprinkling water on the coal and the reaction rate, in Examples 1 to 4.

Water was added to powdered coal after the dewatering, using spray atomization for the water content rate to be each of the values listed in Table 1 and, thereafter, the powdered coal was agglomerated into briquettes each having an oval briquette shape. The agglomerated coal was aged until the reaction rate thereof became each of those listed in Table 1 and was thereafter crushed. Water was sprinkled on the crushed coal for the water content rate to be each of those listed in Table 1 and the reaction rate after the water sprinkling was measured. The result is shown in table 1 and FIG. 2.

Comparative Examples 1 to 4

Figure 3:
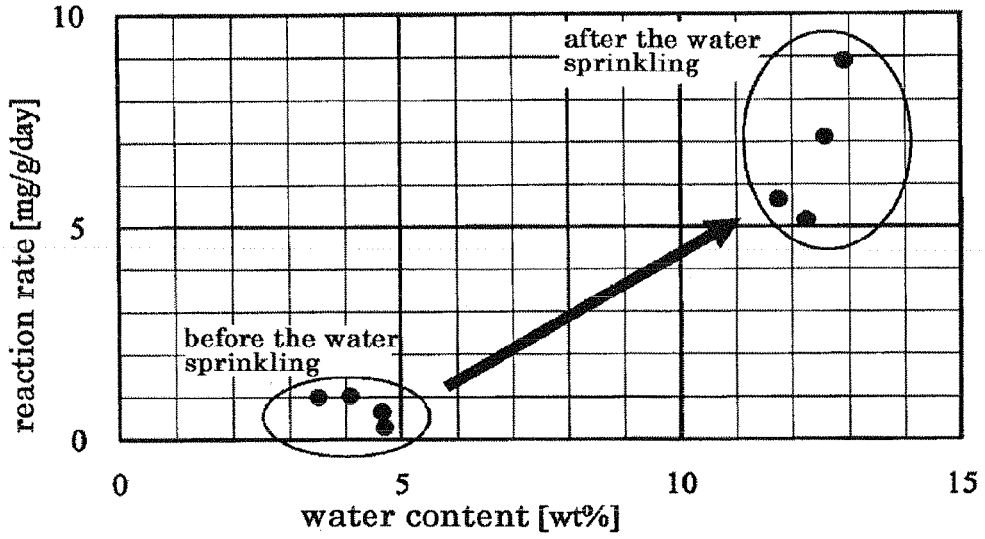
FIG. 3 is a graph showing the relation between the water content rate of the coal crushed after the aging and the reaction rate, and the relation between the water content rate of the coal after sprinkling water on the coal and the reaction rate, in Comparison Examples 1 to 4.

Water was added to powdered coal after the dewatering, using spray atomization for the water content rate to be each of the values listed in Table 1 and, thereafter, the powdered coal was agglomerated into briquettes each having an oval briquette shape. The agglomerated coal was aged until the reaction rate thereof became each of those listed in Table 1 and was thereafter crushed. Water was sprinkled on the crushed coal for the water content rate to be each of those listed in Table 1 and the reaction rate after the water sprinkling was measured. The result is shown in table 1 and FIG. 3.

TABLE 1

| | Water Content Rate Before agglomerating % by Mass | Reaction Rate after Aging mg/g/Day | Water Content Rate after Water Sprinkling % by Mass | Reaction Rate after Water Sprinkling mg/g/Day |
|---|---|---|---|---|
| Example 1 | 6.6 | 0.67 | 11.0 | 1.60 |
| Example 2 | 8.1 | 0.75 | 12.7 | 1.24 |
| Example 3 | 9.2 | 1.08 | 13.5 | 1.47 |
| Example 4 | 8.9 | 0.84 | 13.6 | 1.03 |
| Comparative Example 1 | 4.1 | 1.02 | 12.6 | 7.11 |
| Comparative Example 2 | 4.7 | 0.64 | 12.9 | 8.90 |
| Comparative Example 3 | 4.7 | 0.28 | 11.8 | 5.63 |
| Comparative Example 4 | 3.5 | 0.99 | 12.3 | 5.15 |

As shown in Table 1, the modified coal acquired in each of Examples 1 to 4 each adding the water for preventing the dust generation for the water content rate to be equal to 6% by mass or higher before the agglomerating had the reaction rate that was sufficiently low after the water sprinkling at the secondary addition step and had the spontaneous ignition property that was suppressed to be weak. On the other hand, the modified coal acquired in each of Comparative Examples 1 to 4 whose water content rates before the agglomerating each were lower than 6% by mass had the reaction rate that was high after the water sprinkling and had the spontaneous ignition property that was not sufficiently suppressed.

The present invention has been described in detail and with reference to the specific embodiments while it is apparent to those skilled in the art that various changes and modifications can be made to the present invention without departing from the sprit and the scope thereof.

This application is based on a Japanese patent application filed on Oct. 1, 2013 (Japanese Patent Application No. 2013-206307) and the content thereof is incorporated herein by reference.

INDUSTRIAL APPLICABILITY

As above, according to the method for producing modified coal, modified coal can be acquired that uses low grade coal as the raw material thereof and that is capable of suppressing the dust generation and the spontaneous ignition property. The modified coal is advantageously usable as, for example, fuel for a thermal electric power station and the like.

The invention claimed is:

1. A method for producing modified coal, comprising:
dewatering low grade coal to produce dewatered coal;
adding water to the dewatered coal to produce water-added coal;
agglomerating the water-added coal to produce agglomerated coal;
slowly oxidizing the agglomerated coal to produce oxidized coal; and
crushing the oxidized coal to produce crushed coal, wherein:
in adding the water to the dewatered coal, an addition amount of the water is adjusted such that a water content of the water-added coal is 6% to 16% by mass, and
said method further comprises secondarily adding water to the crushed coal.

2. The method according to claim 1, wherein
in adding the water, the addition amount of the water is adjusted such that the water content of the water-added coal is 6% to 16% by mass and a water content of the crushed coal is 10% to 16% by mass.

3. The method according to claim 1, wherein
in adding the water, the addition amount of the water is adjusted such that the water content of the water-added coal is 6% to 12% by mass, and wherein
in secondarily adding the water, the addition amount of the water is adjusted such that a water content of the crushed coal is 10% to 16% by mass.

4. The method according to claim 1, wherein
in adding the water, a portion or all of the water is added to the dewatered coal by adding low grade coal to the dewatered coal.

5. The method according to claim 1, wherein
in adding the water, the addition amount of the water is adjusted such that the water content of the water-added coal is 8% to 15% by mass and a water content of the crushed coal is 11% to 15% by mass.

6. The method according to claim 1, wherein an upper limit of the oxygen consumption rate of the oxidized coal is 2 mg/g/day.

7. The method according to claim 1, wherein an upper limit of the oxygen consumption rate of the oxidized coal is 1.5 mg/g/day.

8. The method according to claim 1, wherein
in adding the water, the addition amount of the water is adjusted such that the water content of the water-added coal is 6% to 10% by mass, and wherein in secondarily adding the water, the addition amount of the water is adjusted such that a water content of the crushed coal is 10% to 16% by mass.

9. The method according to claim 1, wherein an upper limit of the oxygen consumption rate of the oxidized coal is 1.5 mg/g/day.

10. The method according to claim 1, wherein an upper limit of the oxygen consumption rate of the oxidized coal is 1 mg/g/day.

11. The method according to claim 1, wherein an upper limit of the oxygen consumption rate of the crushed coal is 2 mg/g/day.

12. The method according to claim 1, wherein an upper limit of the oxygen consumption rate of the crushed coal is 1.5 mg/g/day.

* * * * *